US005184552A

United States Patent [19]

Ijichi

[11] Patent Number: 5,184,552

[45] Date of Patent: * Feb. 9, 1993

[54] INK ROLLER FOR ROTARY PRESS

[75] Inventor: Yuji Ijichi, Saitama, Japan

[73] Assignee: Rockwell International Corporation, El Segundo, Calif.

[ * ] Notice: The portion of the term of this patent subsequent to Nov. 28, 2096 has been disclaimed.

[21] Appl. No.: 422,937

[22] Filed: Oct. 17, 1989

Related U.S. Application Data

[63] Continuation of Ser. No. 229,385, Aug. 8, 1988, Pat. No. 4,882,990.

[30] Foreign Application Priority Data

Aug. 18, 1987 [JP] Japan ..... 62-126228[U]
Jan. 26, 1988 [JP] Japan ..... 63-7647[U]

[51] Int. Cl.[5] ..... B41F 1/46; B21H 1/14

[52] U.S. Cl. ..... 101/348; 101/350; 492/28; 492/59

[58] Field of Search ..... 101/153, 157, 348, 349, 101/350; 29/132, 148.4

[56] References Cited

U.S. PATENT DOCUMENTS 3,345,942 10/1967 Meltz ..... 101/349
3,623,965 11/1971 Owren ..... 101/157
4,195,570 4/1980 Haren ..... 101/348

FOREIGN PATENT DOCUMENTS 187576 9/1985 Japan ..... 101/348
167092 7/1987 Japan ..... 101/348
1463284 4/1975 United Kingdom ..... 101/348
87/06627 11/1987 World Int. Prop. O. .

*Primary Examiner*—Edgar S. Burr
*Assistant Examiner*—Ren Yan
*Attorney, Agent, or Firm*—C. B. Patti; V. L. Sewell; H. F. Mamann

[57] ABSTRACT

An ink metering roller for a keyless inking system which comprises a steel or aluminum roller core and an outer surface of highly wear-resistant hard particles imbedded in an oleophilic and hydrophobic bonding matrix, which matrix is subject to wear by contact with a coacting doctor blade, thereby creating gaps or interstices between the hard particles for conveying fixed amounts of input ink to the rotary press.

13 Claims, 2 Drawing Sheets

INK ROLLER FOR ROTARY PRESS

This application is a continuation of a patent application Ser. No. 07/229,385, filed on Aug. 8, 1988, now U.S. Pat. No. 4,882,990.

This invention relates to roller and doctor blade means for keyless metering of ink onto a rotary lithographic printing press.

PRIOR ART

In prior art keyless lithographic inking, the special ink metering roller used in lithographic presses has an engraved steel roller core, the surface of which may be covered with a hard coating of, for example, first copper then ceramic. The edge of a doctor blade is brought into contact with the outer surface of the ceramic coating to assure that the correct amount of ink is reserved in the recesses corresponding to the base roller engravatures.

During use of such an ink roller, the raised or land portions on the surfaces are worn by the doctor blade with the result that the volume of the recesses in the surface is decreased. This reduces the amount of ink that can be delivered by the roller and the roller's oleophilic and hydrophobic properties may be degraded, resulting in unacceptable print quality. A major disadvantage is that the worn and damaged rollers must be replaced. Replacing the roller is generally unacceptable because of the special roller's high initial cost. It was also observed that the doctor blade becomes excessively worn at the same time and does not properly remove excess ink from the roller surface.

It is therefore an object of this invention to provide an ink metering roller that allows long-term use and solves the above problems encountered when using prior art celled ink metering rollers thereby providing a more economical situation. Additionally, with the roller of this invention, the doctor blade edge becomes polished during use, rather than worn away, and does not degrade in its ability to remove excess ink from the roll surface.

Other objects and advantages of this invention will be in part obvious and in part explained by reference to the accompanying specification and drawings in which:

BRIEF DESCRIPTION OF THE DRAWINGS

FIG. 1 illustrates the pertinent parts of a rotary printing press in which the inking roller of this invention is incorporated. In FIG. 1, numeral 1 designates a cylinder having a lithographic printing plate 2 mounted on its surface. Ink 13, contained in ink basin 3, is supplied to the lithographic plate 2 through an ink fountain rubber roller 4, an ink metering roller 5 and set of rollers 6, 7, and 8. Water is supplied simultaneously, by water supply means 11 to roller 7 by way of receiving roller 10 so that the ink rollers 7 and 8 convey water to printing plate 2 simultaneously with the ink.

Figure 1:
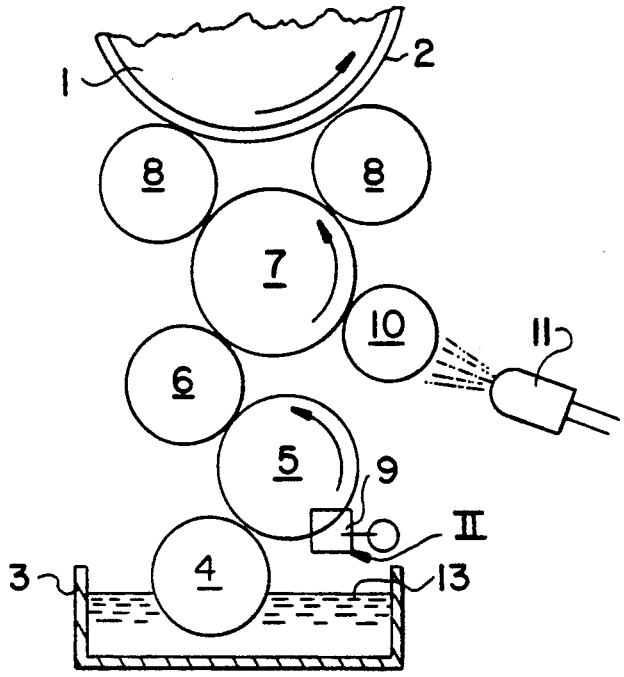
FIG. 1 is a front view illustrating the appropriate parts of a lithographic rotary press having an ink metering roller with doctor blade.
Figure 2:
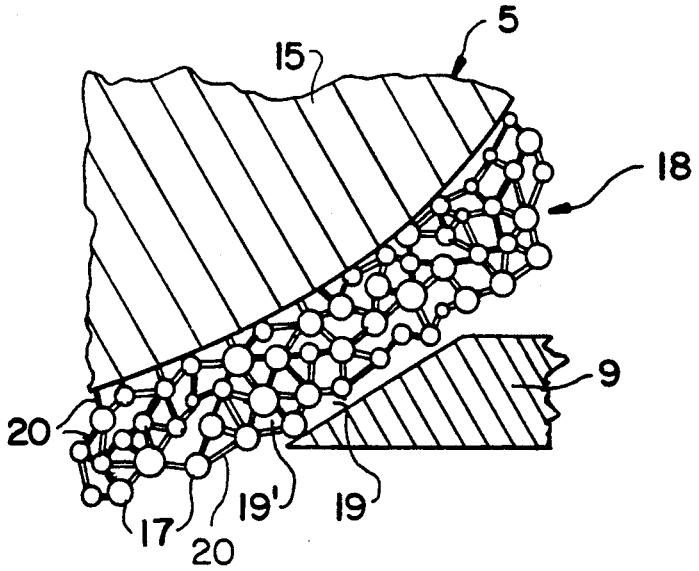
FIG. 2 is an enlarged sectional view of a portion of FIG. 1 enclosed by lines II, illustrating a fragment of an embodiment of FIG. 1.

To accomplish the above objective, the preferred embodiment of the present invention features, as shown in FIG. 2, a composite material 18 composed of highly wear-proof hard particle, or relatively wear resistant element, 17 and a binding material or matrix 20. Binding material 20 may be a hard polymer that binds the hard particles 17 in such a way that minute gaps 19 and 19' are formed in the outer circumferential surface of metering roller 15 due to scraping contact with doctor blade 9. The ink being carried to metering roller 5 by ink fountain roller 4 penetrates into the gaps 19 and 19'. The binder material is selected from among materials that have oleophilic and hydrophobic properties.

Figure 3:
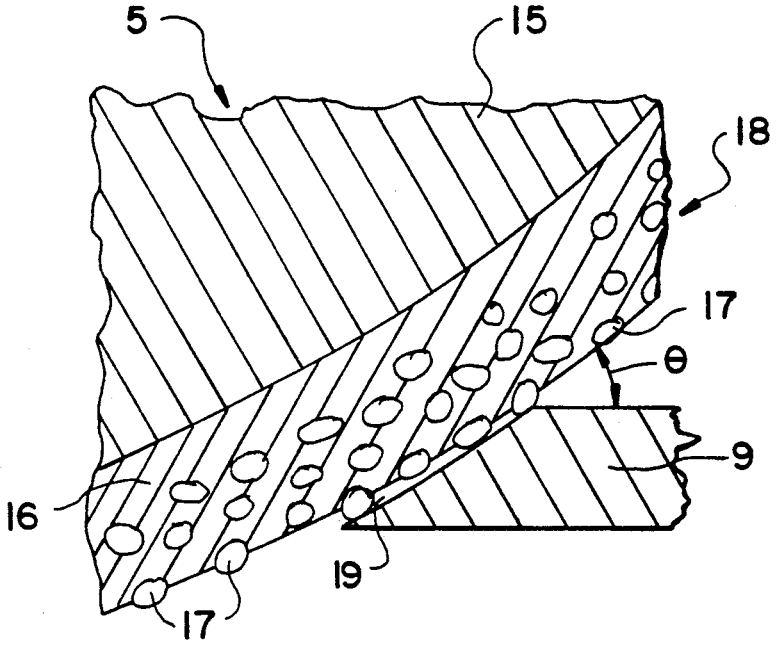
FIG. 3 is an enlarged sectional view of a portion of a type of ink roll of this invention illustrating a fragment of the roll.

During use of ink metering roller 5, the hard particles, or relatively wear resistant elements, 17 and the binding material 20 are abraded by the action of doctor blade 9, fountain rubber roller 4, ink transfer roller 6 and pigment in the ink in such a manner that a portion of the hard particles 17 always protrudes form the nominal surface of metering roller 5. Since the binding material 20 is significantly less resistant to abrading that are the hard particles 17 it is worn away preferentially causing particles 17 to protrude from the outer surface of the material 20. The doctor blade 9 is supported by the outer surface of the metering roller 5 at different levels from the center axis of the roller as the roller surface is worn down. The doctor blade is then in contact with the protruding hard particles, squeezing the excess ink applied by roller 4 into minute gaps 19 and 19' formed between the hard particles 17. The ink in the gaps is subsequently and sequentially transferred to the transfer roller 6, then 7, 8, and 1. As seen in FIGS. 2 and 3, the relatively hard elements 17 are dispersed substantially uniformly and randomly throughout the thickness of the outer layer of composite material 18. Accordingly, as the doctor blade 9 wears through the composite material 18, the relatively hard particles 17 are continuously being worn off and replaced by newly emerging hard particles from successively lower levels of the composite material 18. Consequently, the outer layer, continuously adjusting to wear, is wear adjusted to continuously form new minute ink reservoir recesses as old ones are worn away.

The interior binding material between the interior relatively hard elements 17 thus define a dispersion of potential ink cell locations 19 and 19' when they emerge at the surface as the composite material 18 is worn away. The dispersion of the relatively hard elements 17 within the interior separates, and thereby defines walls between, the potential cells, or gaps, 19 and 19', FIG. 2. During this operation the edge of the doctor blade 9 becomes ground smooth by hard particles 17.

Referring to FIG. 2, the roller core 15 in a specific example was made of steel with surface length of 1710 mm and diameter of 160 mm. Aluminum oxide was used as hard particles 17, although other oxide or carbide particles having about 20 micron average grain size can be used. Larger and smaller grain size particles are acceptable as long as the average size is about 20 microns. The hard particles 17 were mixed together with the binding material 20 to form the composite material which was then coated onto core 15. A phenol formaldehyde resin may be used as binder material 20. Alternately, oxychloride rubber or other resins may be used. Through setting or curing of the binding material 20, the coating gaps 19, 19' were formed between hard particles 17, allowing ink to penetrate through the gaps into the surface of composite material 18 as well as into the interior thereof.

While a preferred embodiment has been shown, it should be appreciated that many variations may be made without departing from the broader scope of the inventive concepts illustrated thereby as specified in the appended claims. Specifically, it should be appreciated that while in the preferred embodiment a composite material of two solids is used to create the dispersion of potential ink cell locations throughout a substantial portion of the depth of the outer layer, such a composite is not necessarily required for creation of such ink cell location.

As seen in the preferred embodiment shown in FIGS. 2 and 3, the dispersion of relatively hard elements, or particles, 17 defines a dispersion of potential ink cell locations therebetween throughout the depth of the outer layer 18. Wear on the surface of the outer layer 18 successively enables a plurality of the potential ink cell locations as they successively appear at the surface of the outer layer 18. When this occurs, they become actual ink cells which are capable of holding a small quantity of ink as the surface of the outer layer 18 is worn. While the matrix material 20 functions to hold the relatively wear resistant elements 17 in the described dispersion, it should be appreciated that if the relatively wear resistant elements, or even individual particles of the matrix material itself, were interconnected to form interstices, or potential ink cell locations, therebetween, a dispersion of potential ink cell locations could also be achieved.

I claim:

1. An ink metering roller for use in a printing press in conjunction with a doctor blade that contacts the surface of the roller to remove excess ink therefrom, comprising:

(a) a core of preselected strength and dimensions; and (b) means providing a surface on said core having recesses to hold ink, said means including an outer ink metering layer having a thickness and covering said core, said outer layer including (i) an outer layer of matrix material having oleophilic and hydrophobic properties, which material is worn away during contact with the doctor blade, and (ii) a quantity of relatively wear resistant elements dispersed through at least a portion of the thickness of said outer layer of matrix material to cause relatively greater wear of said matrix material by the doctor blade to leave some of said relatively wear resistant elements protruding outwardly beyond the outer surface of said matrix material, said outwardly protruding relatively wear resistant particles defining recesses to hold quantities of ink and supporting the doctor blade at different depths of said roller as the outer layer of matrix material is worn away by the doctor blade.

2. The ink metering roller as defined in claim 1 in which said relatively wear resistant element comprises relatively wear resistant particulate material.

3. An ink metering roller as defined in claim 2 wherein said particulate material has an average grain size of twenty microns.

4. An ink metering roller as defined in claim 2 wherein metering layers contains from seventeen to about twenty-five percent of said particulate material by volume.

5. An ink metering roller as defined in claim 2 wherein said ink holding recesses have depths ranging from about five to ten microns.

6. An ink metering roller with a cylindrical core for a printing press, the improvement being a wear adjusting, ink metering, outer layer of selected depth for provision around said core, comprising:

means providing a dispersion of potential ink cell locations throughout a substantial portion of the depth of the outer layer beneath an ink metering surface thereof; and means for successively enabling a plurality of said potential ink cell locations as they successively appear at the surface of the outer layer to become actual ink cells each capable of holding a small quantity of ink as the surface of the outer layer is worn.

7. The ink metering roller of claim 6 in which said potential ink cell dispersion providing means includes a dispersion of elements defining walls between potential cells.

8. The ink metering roller of claim 7, in which the potential ink cell locations providing means includes material between the dispersion of wall defining elements at the surface of the outer layer, and the cell enabling means includes means for wearing away the material between the dispersion of wall defining elements at the surface of the outer layer to form the actual cells from the potential cells.

9. The ink metering roller of claim 8 in which said material that is worn away substantially fills the space between said wall defining elements prior to being worn away.

10. The ink metering roller of claim 8 in which the material worn away to form the actual cells is a different material than that of the wall defining elements.

11. The ink metering roller of claim 10 in which the material of the wall defining elements is relatively harder than the material worn away to form the cells.

12. The ink metering roller of claim 10 in which the material worn away to form the cells is material which fills the cells before the cells are formed.

13. The ink metering roller of claim 6 in which the dispersion is substantially uniform throughout the depth of the outer layer to maintain a uniform ink holding capacity as the surface of the outer layer is worn away.

* * * * *